US011542953B2

(12) United States Patent
Umeyama et al.

(10) Patent No.: US 11,542,953 B2
(45) Date of Patent: Jan. 3, 2023

(54) CENTRIFUGAL COMPRESSOR

(71) Applicant: KABUSHIKI KAISHA TOYOTA JIDOSHOKKI, Aichi-ken (JP)

(72) Inventors: Ryo Umeyama, Aichi-ken (JP); Yoshiyuki Nakane, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 17/374,251

(22) Filed: Jul. 13, 2021

(65) Prior Publication Data

US 2022/0018356 A1 Jan. 20, 2022

(30) Foreign Application Priority Data

Jul. 15, 2020 (JP) ..... JP2020-121242

(51) Int. Cl.

| | |
|---|---|
| ***F04D 29/28*** | (2006.01) |
| ***F04D 29/043*** | (2006.01) |
| ***F04D 17/10*** | (2006.01) |
| ***F04D 29/30*** | (2006.01) |

(52) U.S. Cl.

CPC ..... *F04D 29/284* (2013.01); *F04D 17/10* (2013.01); *F04D 29/043* (2013.01); *F04D 29/30* (2013.01)

(58) Field of Classification Search

CPC ..... F04D 29/284; F04D 17/10; F04D 29/043; F04D 29/30

USPC ..... 416/182

See application file for complete search history.

(56) References Cited

U.S. PATENT DOCUMENTS 1,180,602 A * 4/1916 Pfau ..... F04D 29/2266 415/106
1,473,802 A * 11/1923 Woock ..... F04D 29/167 415/106
1,871,747 A * 8/1932 Schlachter ..... F04D 29/2266 415/106
2,658,455 A * 11/1953 Seinfeld ..... F04D 29/2266 415/106
3,213,794 A * 10/1965 Adams ..... F04C 19/00 417/69
3,316,848 A * 5/1967 Egger ..... F04D 29/445 415/196
3,944,406 A * 3/1976 Jagusch ..... F04D 9/003 416/186 A
4,086,020 A * 4/1978 Tanabe ..... F04D 29/0416 415/106
4,872,806 A * 10/1989 Yamada ..... F04D 29/188 415/55.5

(Continued)

FOREIGN PATENT DOCUMENTS

JP 2018-168707 A 11/2018
JP 2018168707 A * 11/2018 ..... F04D 29/051

*Primary Examiner* — Hung Q Nguyen
*Assistant Examiner* — Anthony Donald Taylor, Jr.
(74) *Attorney, Agent, or Firm* — Greenblum & Bernstein, P.L.C.

(57) ABSTRACT

A centrifugal compressor comprises an impeller including a hub and a plurality of blades. The hub is provided with a through hole. The hub has an external radial surface having an inner external radial surface and an outer external radial surface. The outer external radial surface is formed closer to a back surface than an imaginary curved surface having as a radius a radius of curvature of the inner external radial surface at a radially outer edge thereof.

7 Claims, 4 Drawing Sheets

(56) References Cited

U.S. PATENT DOCUMENTS 4,877,368 A * 10/1989 Timperi ..... F04D 29/2261 366/156.1
4,890,980 A * 1/1990 Heald ..... F04D 29/2277 416/183
4,921,400 A * 5/1990 Niskanen ..... F04D 9/003 96/213
4,971,519 A * 11/1990 Timperi ..... F04D 29/2288 96/213
4,981,413 A * 1/1991 Elonen ..... F04D 9/003 415/115
4,997,340 A * 3/1991 Zinsmeyer ..... F04D 29/0516 415/105
5,019,136 A * 5/1991 Elonen ..... F04D 29/428 415/168.1
5,106,263 A * 4/1992 Irie ..... F04D 29/2255 415/206
5,116,198 A * 5/1992 Vesala ..... F04D 7/045 415/143
5,156,522 A * 10/1992 Tessier ..... F04D 29/445 415/58.4
5,167,678 A * 12/1992 Elonen ..... F04D 29/428 96/214
5,224,821 A * 7/1993 Ozawa ..... F04D 29/2222 416/223 R
5,324,166 A * 6/1994 Elonen ..... B01D 19/0052 96/214
5,542,817 A * 8/1996 Brandt ..... F04D 29/2288 415/106
5,628,616 A * 5/1997 Lee ..... F04D 29/2288 415/199.1
5,711,789 A * 1/1998 Elonen ..... B01D 19/0052 96/216
5,842,833 A * 12/1998 Reponen ..... F04D 9/04 417/69
5,873,697 A * 2/1999 Gully ..... F04D 29/167 29/888.021
6,120,252 A * 9/2000 Reponen ..... F04D 7/045 417/69
6,551,054 B1 * 4/2003 Peltonen ..... F04D 7/045 415/72
6,893,207 B2 * 5/2005 Kao ..... F04D 29/2288 415/58.2
7,175,384 B2 * 2/2007 Algers ..... F04D 29/2266 415/171.1
8,246,296 B2 * 8/2012 Smith ..... F01D 5/145 415/115
8,444,370 B2 * 5/2013 Gulich ..... F04D 29/2266 415/1
9,951,786 B2 * 4/2018 Elebiary ..... F04D 29/2266
2006/0263200 A1 * 11/2006 Ahlroth ..... F04D 29/2266 415/58.2
2017/0122339 A1 * 5/2017 Sun ..... F02B 37/04
2018/0135643 A1 * 5/2018 Kawaguchi ..... F04D 29/706

* cited by examiner

CENTRIFUGAL COMPRESSOR

This nonprovisional application is based on Japanese Patent Application No. 2020-121242 filed on Jul. 15, 2020 with the Japan Patent Office, the entire contents of which are hereby incorporated by reference.

BACKGROUND OF THE INVENTION

Field of the Invention

The present invention relates to a centrifugal compressor.

Description of the Background Art

For example, Japanese Patent Laid-Open No. 2018-168707 discloses a centrifugal compressor including an impeller. The impeller in the centrifugal compressor has a hub having an external radial surface and a back surface, and a plurality of blades. The hub is provided with a through hole formed therethrough between the external radial surface and the back surface. The through hole thus formed reduces a moment of inertia of the impeller and a thrust load acting on the impeller.

SUMMARY OF THE INVENTION

For the impeller of the centrifugal compressor described in Japanese Patent Laid-Open No. 2018-168707, a portion of an air current flowing toward a discharging side along the external radial surface of the hub may collide with a portion of an inner circumferential surface surrounding the through hole that is located downstream of the air current, and accordingly, flow toward the back surface of the impeller through the through hole. This results in reduced performance (or a reduced pressure ratio).

An object of the present invention is to provide a centrifugal compressor capable of achieving both reduction in moment of inertia of an impeller and in thrust load acting on the impeller, and suppression of reduction in pressure ratio.

A centrifugal compressor according to an aspect of the present invention is a centrifugal compressor comprising a rotation shaft and an impeller fixed to the rotation shaft and rotating together with the rotation shaft, the impeller including a hub having an external radial surface having a shape gradually increasing in diameter from one side of the rotation shaft toward the other side of the rotation shaft and a back surface formed on the other side of the rotation shaft, and a plurality of blades provided on the external radial surface of the hub, the hub being provided with a through hole formed therethrough between the external radial surface and the back surface, the external radial surface having an inner external radial surface located inwardly of the through hole in a radial direction of the hub and an outer external radial surface located outwardly of the through hole in the radial direction of the hub, the outer external radial surface being formed closer to the back surface than an imaginary curved surface having as a radius a radius of curvature of the inner external radial surface at an edge thereof outer in the radial direction.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will now be described with reference to the drawings. In the figures referred to below, any identical or equivalent member is identically denoted.

Figure 1:
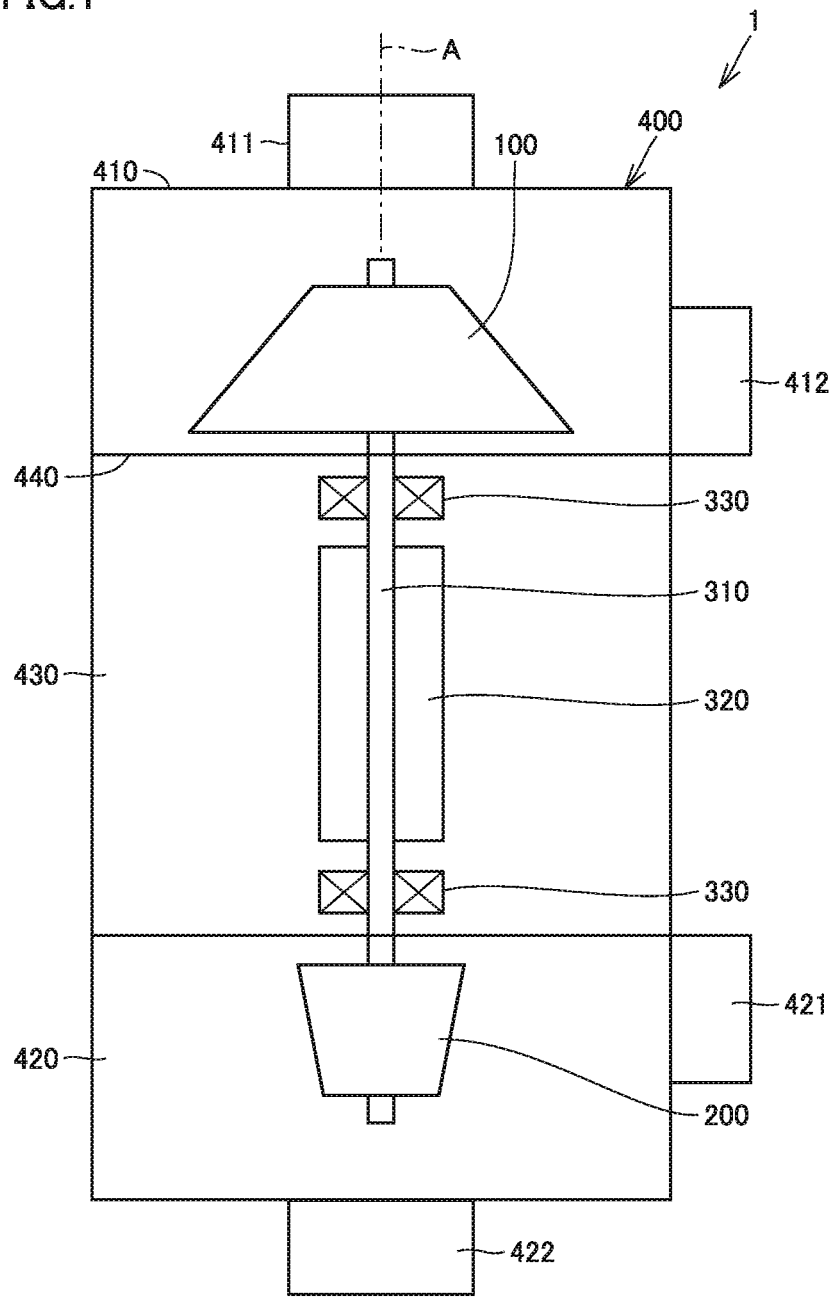
FIG. 1 is a diagram schematically showing a configuration of a centrifugal compressor according to an embodiment of the present invention.

FIG. 1 is a diagram schematically showing a configuration of a centrifugal compressor according to an embodiment of the present invention. As shown in FIG. 1, the centrifugal compressor 1 includes an impeller 100, a turbine wheel 200, a rotation shaft 310, a motor 320, a bearing 330, and a casing 400.

The rotation shaft 310 interconnects the impeller 100 and the turbine wheel 200. The rotation shaft 310 is rotationally driven by the motor 320. The rotation shaft 310 is received by the bearing 330. The motor 320 includes a rotor and a stator (not shown).

The casing 400 houses the impeller 100, the turbine wheel 200, the rotation shaft 310, the motor 320, and the bearing 330. The casing 400 has a compressor housing 410, a turbine housing 420, and a center housing 430.

The compressor housing 410 houses the impeller 100. The compressor housing 410 has a suction port 411 and a discharge unit 412. A diffuser (not shown) is provided in the compressor housing 410 on a discharging side of the impeller 100.

The turbine housing 420 houses the turbine wheel 200. The turbine housing 420 has a suction unit 421 and a discharge port 422.

The center housing 430 is disposed between the compressor housing 410 and the turbine housing 420. The center housing 430 houses the motor 320 and the bearing 330.

The center housing 430 has a rear housing 440. The rear housing 440 is provided between the impeller 100 and the bearing 330. The rear housing 440 has an opposite surface 442 (see FIG. 4) facing the impeller 100. The opposite surface 442 is formed flat.

Figure 2:
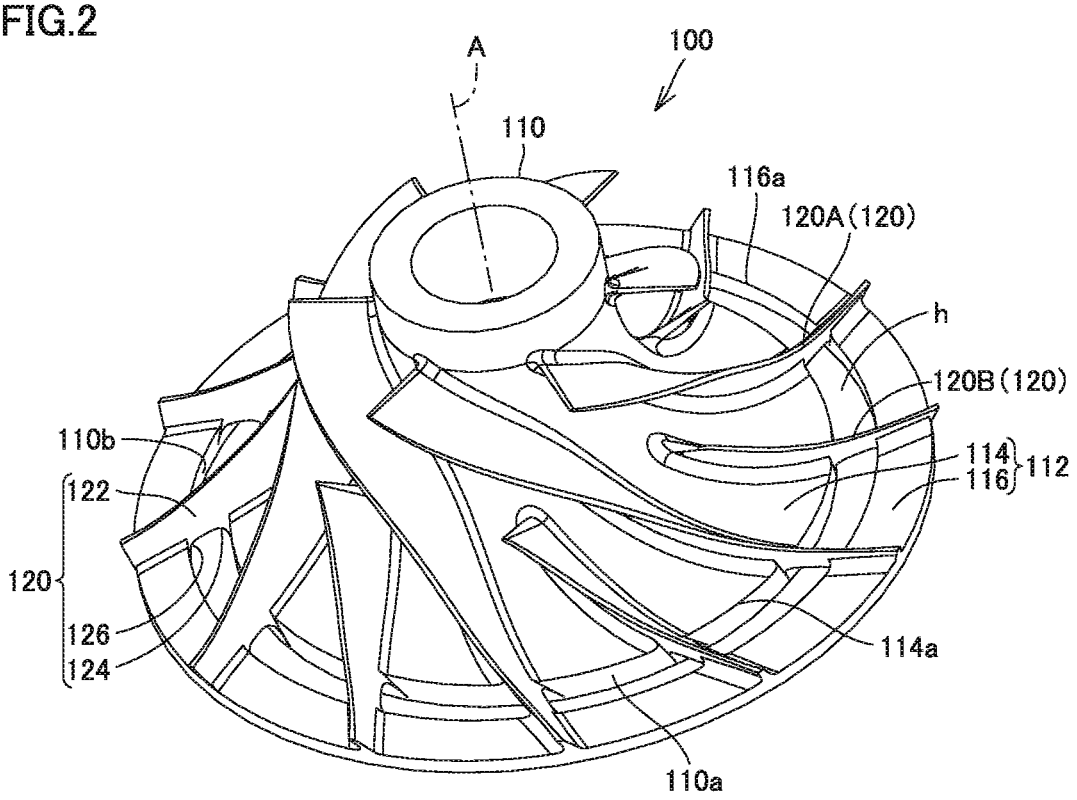
FIG. 2 is a perspective view of an impeller.
Figure 3:
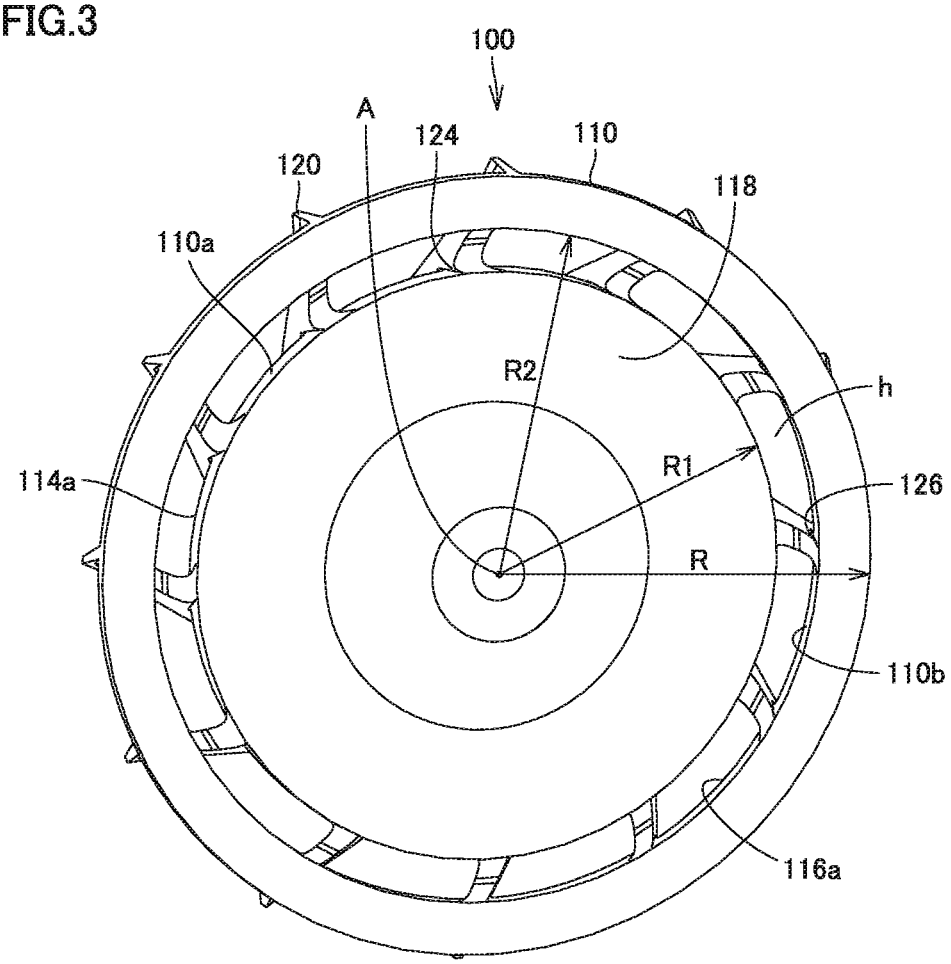
FIG. 3 is a perspective view of the impeller at an angle different from that in FIG. 2.

The impeller 100 receives gas (e.g., air) sucked through the suction port 411 and discharges the gas through the discharge unit 412. The impeller 100 is fixed to the rotation shaft 310 and rotates about an axis A together with the rotation shaft 310. As shown in FIGS. 2 and 3, the impeller 100 includes a hub 110 and a plurality of blades 120.

The hub 110 is fixed to the rotation shaft 310 and is rotatable about the axis A. In the present embodiment, the axis A corresponds to an axis of center of rotation of the rotation shaft 310. The hub 110 has an external radial surface 112 and a back surface 118.

The external radial surface 112 has a shape increasing in diameter from one side (an upper side in FIG. 1) of the rotation shaft 310 (the axis of center of rotation) toward the other side (a lower side in FIG. 1) of the rotation shaft 310. In other words, the external radial surface 112 has a shape having an outer diameter gradually increasing from an end portion on the suction side toward an end portion on the discharging side. As the external radial surface 112 extends from one side toward the other side, the external radial surface 112 has a shape curved to be convex in a direction approaching the rotation shaft 310.

The back surface 118 is orthogonal to the axis A. The back surface 118 is formed on the other side (or the discharging side). The back surface 118 is formed flat.

The hub 110 is provided with a through hole h formed therethrough between the external radial surface 112 and the back surface 118. In the present embodiment, the through hole h is formed in an annulus around the axis A without interruption. The through hole h penetrates the hub 110 in a direction parallel to the axis A. The through hole h is preferably formed near an outer edge of the hub 110.

The external radial surface 112 of the hub 110 has an inner external radial surface 114 and an outer external radial surface 116.

The inner external radial surface 114 is an external radial surface located inwardly of the through hole h in the radial direction of the hub 110.

Figure 4:
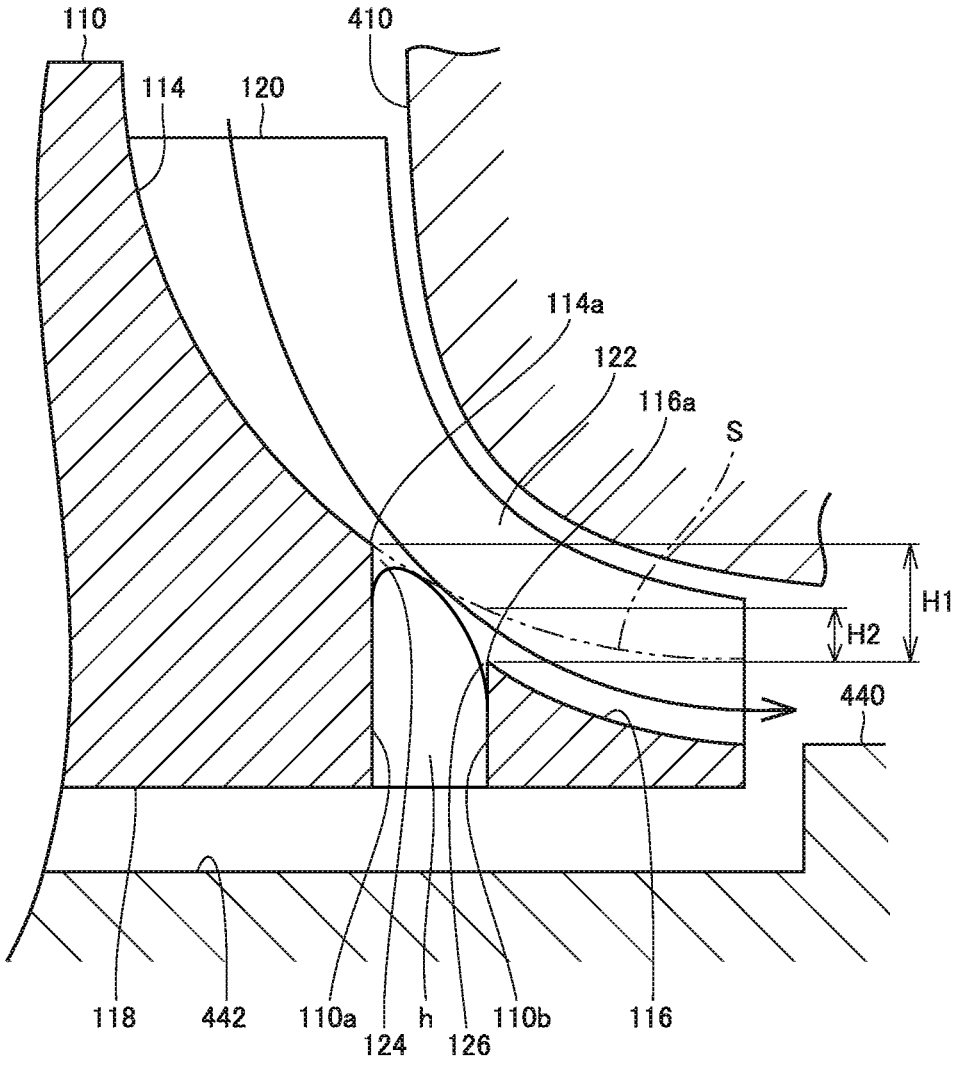
FIG. 4 schematically shows the impeller in cross section.

The outer external radial surface 116 is an external radial surface located outwardly of the through hole h in the radial direction of the hub 110. In the present embodiment, the outer external radial surface 116 is formed in an annulus (or a ring). As shown in FIG. 4, the outer external radial surface 116 is formed closer to the back surface 118 than an imaginary curved surface S having as a radius of curvature of the inner external radial surface 114 at an edge 114*a* thereof outer in the radial direction. That is, the outer external radial surface 116 has a radially inner edge 116*a* located closer to the back surface 118 than the imaginary curved surface S. The back surface 118 behind the outer external radial surface 116 is flush with the back surface 118 behind the inner external radial surface 114.

The external radial surface 112 of the hub 110 has a radius R (see FIG. 3) and an inner radius R1 delimited by through hole h (see FIG. 3), preferably with a ratio R1/R of 0.74 or more and 0.8 or less. In the present embodiment, the ratio R1/R is 0.745. Further, the external radial surface 112 of the hub 110 has an outer radius R2 delimited by the through hole h (see FIG. 3), preferably with a ratio R2/R of 0.85 or more and 0.9 or less. In the present embodiment, the ratio R2/R is 0.855.

Note that the inner diameter R1 means a distance from the axis A to the outer edge 114*a*. The outer diameter R2 means a distance from the axis A to the inner edge 116*a*.

Furthermore, when a distance between the outer edge 114*a* and the inner edge 116*a* in a direction parallel to the axis A is represented as H1 (see FIG. 4) and a distance between the imaginary curved surface S and the inner edge 116*a* in the direction parallel to the axis A is represented as H2 (see FIG. 4), a ratio of H2/H1 is preferably larger than 0 and smaller than 1. More preferably, $0.1<H2/H1<1$. In the present embodiment, the ratio H2/H1 is 0.4.

Each blade 120 is provided on the external radial surface 112 of the hub 110. Each blade 120 has a shape extending from the inner external radial surface 114 to reach the outer external radial surface 116. Each blade 120 interconnects the inner external radial surface 114 and the outer external radial surface 116. The plurality of blades 120 have a plurality of first blades 120A and a plurality of second blades 120B.

The first blade 120A has a shape extending to reach the outer external radial surface 116 from the inner external radial surface 114 in a vicinity of one end thereof located on the one side.

The second blade 120B has a shape extending to reach the outer external radial surface 116 from a radially middle portion of the inner external radial surface 114.

As shown in FIGS. 2 to 4, each blade 120 has a blade body 122, an inner connecting portion 124, and an outer connecting portion 126.

The blade body 122 has a shape extending from the inner external radial surface 114 to reach the outer external radial surface 116. The blade body 122 is tilted in a direction in which the hub 110 rotates.

The inner connecting portion 124 is provided at a boundary portion between the blade body 122 and a portion 110*a* of a side surface defining the through hole h in the hub 110 that is closer to the rotation shaft 310. As the inner connecting portion 124 is farther away from the back surface 118, the inner connecting portion 124 has a shape curved to be convex in a direction approaching the rotation shaft 310.

The outer connecting portion 126 is provided at a boundary portion between the blade body 122 and a portion 110*b* of a side surface defining the through hole h in the hub 110 that is farther from the rotation shaft 310. As the outer connecting portion 126 is farther away from the back surface 118, the outer connecting portion 126 has a shape curved to be convex in a direction farther away from the rotation shaft 310.

Thus, the centrifugal compressor 1 of the present embodiment, as compared with a case with the impeller 100 having the outer external radial surface 116 shaped along the imaginary curved surface S, has the outer external radial surface 116 reduced in thickness and hence reduce a moment of inertia of the impeller 100. Further, an air current flowing toward the discharging side along the inner external radial surface 114 flows toward the discharging side along the outer external radial surface 116, as indicated in FIG. 4 by an arrow. This suppresses collision of the air current against the portion 110*b* of a side surface defining the through hole h that is located downstream of the air current. The centrifugal compressor 1 thus achieves both reduction in moment of inertia of the impeller 100 and in thrust load acting on the impeller 100, and suppression of reduction in pressure ratio.

For example, the through hole h may not be formed in an annulus without interruption, and may instead be formed at intervals in a circumferential direction of the hub 110.

Further, the blades 120 may all be shaped identically.

[Manner]

It will be appreciated by those skilled in the art that the above exemplary embodiment is a specific example of the following manner:

The centrifugal compressor 1 according to an aspect of the present disclosure is a centrifugal compressor comprising a rotation shaft and an impeller fixed to the rotation shaft and rotating together with the rotation shaft, the impeller including a hub having an external radial surface having a shape gradually increasing in diameter from one side of the rotation shaft toward the other side of the rotation shaft and a back surface formed on the other side of the rotation shaft, and a plurality of blades provided on the external radial surface of the hub, the hub being provided with a through hole formed therethrough between the external radial surface and the back surface, the external radial surface having an inner external radial surface located inwardly of the through hole in a radial direction of the hub and an outer external radial surface located outwardly of the through hole in the radial direction of the hub, the outer external radial surface being formed closer to the back surface than an imaginary curved surface having as a radius a radius of curvature of the inner external radial surface at an edge thereof outer in the radial direction.

The present centrifugal compressor, as compared with an impeller having an outer external radial surface shaped along an imaginary curved surface, reduces a moment of inertia of the impeller and also suppresses collision of an air current against a portion of a side surface defining the through hole that is located downstream of the air current. The present centrifugal compressor thus achieves both reduction in moment of inertia of the impeller and in thrust load acting on the impeller, and suppression of reduction in pressure ratio.

A ratio of a distance in a direction parallel to the rotation shaft between the imaginary curved surface and an edge of the outer external radial surface inner in the radial direction to a distance in the direction parallel to the rotation shaft between the outer edge and the inner edge is preferably larger than 0 and smaller than 1.

Further, the blades each preferably have a blade body having a shape extending from the inner external radial surface to reach the outer external radial surface, an inner connecting portion provided at a boundary portion between the blade body and a portion of a side surface defining the through hole in the hub that is closer to the rotation shaft, and an outer connecting portion provided at a boundary portion between the blade body and a portion of a side surface defining the through hole in the hub that is farther from the rotation shaft.

This reduces stress generated at a boundary portion between the blade body and the hub.

Further, preferably, as the inner connecting portion is farther away from the back surface, the inner connecting portion has a shape curved to be convex in a direction approaching the rotation shaft.

This reduces stress generated in the inner connecting portion.

Further, preferably, as the outer connecting portion is farther away from the back surface, the outer connecting portion has a shape curved to be convex in a direction farther away from the rotation shaft.

This reduces stress generated in the outer connecting portion.

Further, preferably, the through hole is annularly formed, a ratio to the radius of the external radial surface of the hub of an inner radius of the external radial surface of the hub delimited by the through hole is 0.74 or more and 0.8 or less and a ratio to the radius of the external radial surface of the hub of an outer radius of the external radial surface of the hub delimited by the through hole is 0.85 or more and 0.9 or less, and the blades each interconnect the inner external radial surface and the outer external radial surface.

This further reduces moment of inertia and thrust load.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A centrifugal compressor comprising a rotation shaft and an impeller fixed to the rotation shaft and rotating together with the rotation shaft, the impeller including a hub having an external radial surface having a shape gradually increasing in diameter from a first side of the rotation shaft toward a second side of the rotation shaft, and a back surface formed on the second side of the rotation shaft, and a plurality of blades provided on the external radial surface of the hub, the hub being provided with a through-hole formed therethrough between the external radial surface and the back surface, the external radial surface having an inner external radial surface located inwardly of the through-hole in a radial direction of the hub, the inner external radial surface having a radius of curvature at an outer edge of the inner external radial surface in the radial direction of the hub, and an outer external radial surface located outwardly of the through-hole in the radial direction of the hub, the outer external radial surface being formed closer to the back surface than an imaginary curved surface extending along the radius of curvature of the inner external radial surface.

2. The centrifugal compressor according to claim 1, wherein a ratio of a distance in a direction parallel to the rotation shaft between the imaginary curved surface and an inner edge of the outer external radial surface to a distance in the direction parallel to the rotation shaft between the outer edge and the inner edge is larger than 0 and smaller than 1.

3. The centrifugal compressor according to claim 1, wherein each blade of the plurality of blades has:

a blade body having a shape extending from the inner external radial surface to the outer external radial surface;

an inner connecting portion provided at a first boundary portion between the blade body and a portion of a first side surface defining the through-hole in the hub; and an outer connecting portion provided at a second boundary portion between the blade body and a portion of a second side surface defining the through-hole in the hub.

4. The centrifugal compressor according to claim 3, wherein as the inner connecting portion extends farther away from the back surface, the inner connecting portion has a shape curved to be convex in a direction approaching the rotation shaft.

5. The centrifugal compressor according to claim 3, wherein as the outer connecting portion extends farther away from the back surface, the outer connecting portion has a shape curved to be convex in a direction away from the rotation shaft.

6. The centrifugal compressor according to claim 3, wherein the through-hole is annularly formed, a ratio of an inner radius of the external radial surface of the hub delimited by the through-hole to a radius of the external radial surface of the hub is 0.74 or more and 0.8 or less, a ratio of an outer radius of the external radial surface of the hub delimited by the through-hole to the radius of the external radial surface of the hub is 0.85 or more and 0.9 or less, and the blades each interconnect the inner external radial surface and the outer external radial surface.

7. The centrifugal compressor according to claim 1, further comprising a compressor housing in which the impeller is arranged, wherein a first orthogonal distance between a surface of the compressor housing and the outer edge of the inner external radial surface is smaller than a second orthogonal distance between the surface of the compressor housing and an inner edge of the outer external radial surface.

* * * * *